United States Patent [19]

Marriott

[11] 3,982,092

[45] Sept. 21, 1976

[54] ELECTRICALLY HEATED ZONED WINDOW SYSTEMS

[75] Inventor: James G. Marriott, Perrysburg, Ohio

[73] Assignee: Libbey-Owens-Ford Company, Toledo, Ohio

[22] Filed: Sept. 6, 1974

[21] Appl. No.: 503,808

[52] U.S. Cl. ..... 219/203; 52/171; 219/486; 219/522; 219/543; 219/547; 244/134 D

[51] Int. Cl.[2] ..... H05B 1/02; E06B 7/12; H05B 3/10

[58] Field of Search ..... 219/202, 203, 543, 547, 219/522, 486, 487; 296/84 R, 84 E; 52/171; 244/134 D

[56] References Cited

UNITED STATES PATENTS

| | | | |
|---|---|---|---|
| 1,758,703 | 5/1930 | Johnson | 219/203 UX |
| 2,530,980 | 11/1950 | Mershon | 219/203 X |
| 2,866,881 | 12/1958 | McMillen | 219/203 UX |
| 3,475,588 | 10/1969 | McMaster | 219/203 |
| 3,790,745 | 2/1974 | Levin | 219/203 |

FOREIGN PATENTS OR APPLICATIONS

| | | | |
|---|---|---|---|
| 1,912,667 | 3/1969 | Germany | 219/522 |

*Primary Examiner*—A. Bartis
*Attorney, Agent, or Firm*—Collins, Oberlin & Darr

[57] ABSTRACT

An electrically heated window system having at least two independently heatable zones wherein each zone includes its own independent resistance heating element which provides a path for the flow of electric current. A selected region in one of the zones includes a secondary heating component which produces a relatively high temperature in this region of the zone which controls a thermostat in thermal contact therewith. The thermostat initially connects an electrical potential to the one zone and then automatically cycles the electrical potential between the two zones in accordance with the rise and fall of the temperature in said selected region.

13 Claims, 8 Drawing Figures

ELECTRICALLY HEATED ZONED WINDOW SYSTEMS

BACKGROUND OF THE INVENTION

1. Field of the Invention

This invention generally relates to electrical resistance heated windows and, more particularly, to a defrosting and demisting system for motor vehicle viewing closures.

2. Description of the Prior Art

At the present time the most common system of defrosting and demisting the windows of a motor vehicle by electrical resistance heating is to provide the window with a conductive surface and apply an electric potential thereto to heat the window over its entire viewing area. Since the supply of electrical energy available in motor vehicles is limited, the rate of defrosting and demisting the window is quite low.

It is of course desirable to defrost and demist the critical viewing areas of the vehicle windows as rapidly as possible. Thus, in the past it has been proposed to divide a vehicle window into zones and first heat only a small zone, i.e., the area immediately in an operator's line of vision, with the available electrical energy and thereafter apply the same energy over the entire viewing area of the window. In this manner, a vehicle operator is quickly provided with a limited field of vision and subsequently with a total field of vision. Such a window heating system is shown in British Pat. No. 1,300,115, published on Dec. 20, 1972.

Also, it has been proposed to employ a temperature sensing device in the first heated zone of a window for automatically switching the electrical potential in sequence to additional zones and then to the entire window as the temperature in each zone reaches a predetermined level. For an example of such a window heating system, see U.S. Pat. No. 3,475,588.

A critical problem in the window defrosting and demisting art lies in the fact that the conditions of defrosting and demisting a window are quite different. For example, either ice or frost will appear on a window when the relative humidity of the atmosphere is high and the ambient temperature is below the freezing point of water. In this situation, it is only necessary to heat the window to some temperature above the freezing point of water to melt the ice or frost on the window. On the other hand, when the relative humidity of the surrounding atmosphere is high and the ambient temperature is below its dew point, moisture will appear on the window. In this situation, it is necessary to heat the window to a temperature above the dew point to remove condensation from the window. Thus, it is apparent that the vehicle window must be heated over a broad range of temperatures to melt ice and remove condensation therefrom.

Although the aforementioned prior art window heating systems will remove ice and moisture from a window, they are not entirely satisfactory in that when a large amount of heat is first applied to a limited area of the window, the temperature therein will rise quite high. However, as soon as the amount of heat is reduced or transferred to another area of the window, the temperature in the first area may drop thereby permitting the reoccurrence of condensation or even ice in the first area.

SUMMARY OF THE INVENTION

Generally speaking, the instant invention overcomes the aforementioned problem and disadvantage of the prior art by cycling the application of electrical potential between two heatable window zones.

Generally, the invention comprises two independent electrical heating elements, the first one of which extends over a first zone while the second element extends over a second zone. One of the heating elements, for example the first heating element, is provided with a secondary heating component which may be a portion of the first heating element for heating a selected region of the first zone to a higher temperature than the remainder of the zone. A thermostat is placed in thermal contact with the selected region to connect initially a source of electrical energy to the first element along and then when the selected region of the first zone is heated to a predetermined maximum temperature, switches the application of electrical potential to the second heating element. When the glass temperature in the selected region drops below a predetermined minimum, the thermostat automatically cycles the electrical potential again to the first heating element to prevent the reoccurrence of frost or condensation on the glass in its zone. The invention may be incorporated in a single window such as a vehicle backlight which is divided into two independent heating zones, or in two separate windows such as a windshield and a backlight each of which is provided with a heating zone.

OBJECTS AND ADVANTAGES

Accordingly, an object of this invention is to provide a novel heated window system with means for controlling the application of heat independently to two heatable zones to rapidly effect the removal of frost and condensation in one of the zones prior to the other and then prevent the re-formation of frost and condensation therein.

Another object of this invention is to provide a heated window system of the above type wherein one of the heatable zones includes a high heat region for supplying a control temperature.

Other objects and advantages will become more apparent during the course of the following description when taken in connection with the accompanying drawings.

BRIEF DESCRIPTION OF THE DRAWINGS

In the drawings, wherein like numerals are employed to designate like parts throughout the same.

DESCRIPTION OF THE PREFERRED EMBODIMENTS

Figure 1:
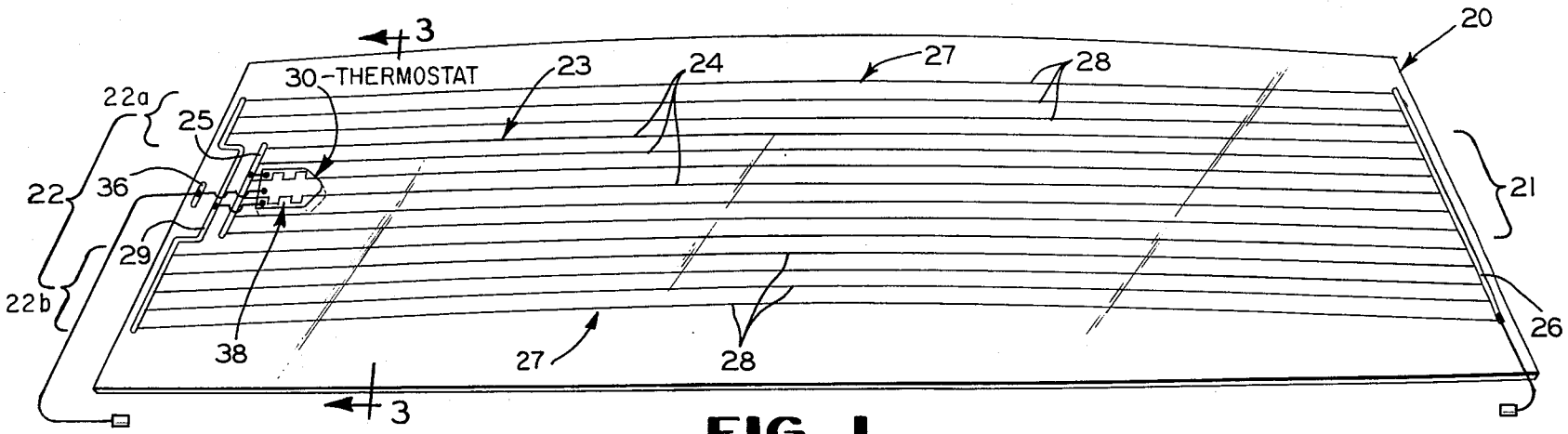
FIG. 1 is a perspective view of a motor vehicle window which incorporates the features of this invention as viewed looking from its outboard surface.
Figure 3:
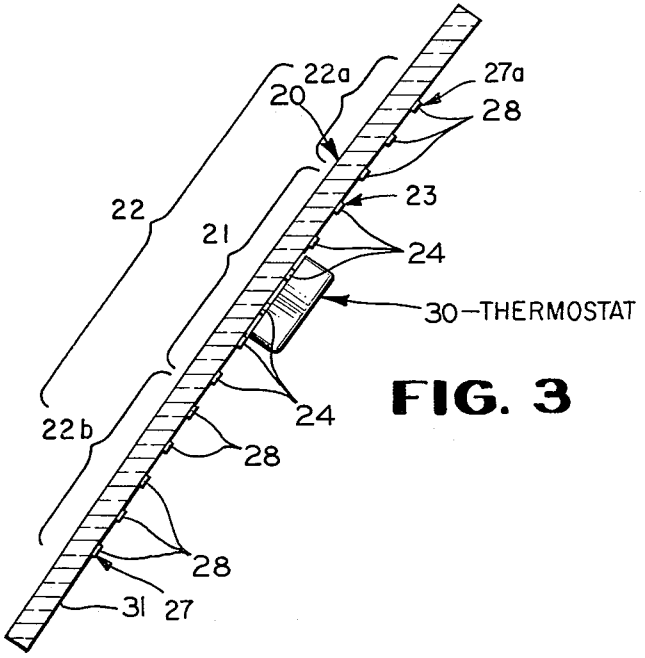
FIG. 3 is an enlarged fragmentary cross sectional view taken substantially along line 3—3 of FIG. 1.

The invention as illustrated in FIG. 1, is incorporated in a motor vehicle window such as a backlight 20. In this case, it is desirable to first defrost and demist the central area of the backlight to quickly provide an operator with a limited field of vision and subsequently with a total field of vision to the rear of a vehicle.

Thus, according to this invention, the central area of the backlight 20 is provided with a first heatable zone 21 which extends transversely thereacross and a second heatable zone 22 which is constructed in two parallel sections 22*a* and 22*b*, one section 22*a* lying above the zone 21 and the other section 22*b* lying below the zone 21. The first heatable zone 21 is provided with a resistance heating element 23 formed by a series of parallel electroconductive lines 24 running between and connected to a pair of bus bars 25 and 26 to permit the flow of electrical current from one of the bus bars 25 to the other bus bar 26. The lines 24 may be comprised, for example, of an electrically conducting metal-glass frit mixture blended to provide the desired electrical resistance when fired onto the glass surface in a manner well known in the art, as an example thereof see U.S. Pat. No. 3,046,433. The second heatable zone 22 is provided with a heating element 27 also formed by a series of parallel electroconductive lines 28 running between and connected to the bus bar 26 and a bus bar 29 to permit the flow of electrical current therebetween. The heating elements 23 and 27 are electrically insulated from each other and thus independently heat their respective zones of the backlight 20.

Preferably, the heating element 23 is comprised of a lesser number of conductor lines 24 than the heating element 27, with the former being comprised of six lines 24 and the latter eight lines 28 in the embodiment of FIG. 1. In this manner, the heating element 23 will carry a larger electrical current when impressed with the battery voltage so that the centrally disposed heating zone 21 of the backlight 20 is supplied with a relatively high heat. For example, the conventionally heated backlight in use today is normally provided with a 12 volt–20 ampere electrical system, thus, zone 21 would be supplied with a current of 20 amperes for the six conductor lines 24 or 20/6 amperes per line. On the other hand, zone 22 will also be supplied with a current of 20 amperes but over the eight conductor lines 28 or 20/8 amperes per line. Therefore, the lineal resistance (ohms per foot) of zones 21 and 22 will be different and the power density (watts per unit area) or heat density will be greater in zone 21, even though the power input (voltage) to both zones is the same. The central region of a frosted or misted backlight 20 is therefore very rapidly freed of frost or mist when the heating element 23 is connected into the electrical circuit which will be described hereinafter. When the heating element 27 is connected into the circuit, the current consumption will drop because of the larger number of conductive lines 28 employed therein and the resulting increase in resistance. The backlight 20, therefore, will be heated in the zone 22 but by a smaller heating power and thus, frost and mist is removed from this region of the backlight at a slower rate.

Included in the first heatable zone 21 is a temperature sensing means such as a conventional thermostat 30 which initially connects a supply of electrical potential to the heating element 23. The thermostat 30 is enclosed in a casing which has a sensing portion in thermal contact with the inboard surface 31 of the backlight 20 and may be secured thereto by well known adhesives. The operating element thereof is a thermally operable switch indicated generally at 32 in FIG. 4, the specific details of which need not be shown. It is sufficient here merely to consider that the thermostat 30 cycles the supply of electrical potential between the heating elements 23 and 27 at the limits of its differential temperature range. The thermostatic switch 32 has terminals 33 and 34 which are connected to the bus bars 25 and 29, respectively and a line terminal 35 which is connected to a terminal bar 36 on the backlight 20 for connection to a supply of electrical potential.

Because of vibration problems in a motor vehicle, it is preferable to use a disc-type thermostat in the window heating system rather than a leaf-type thermostat which would tend to change positions due to the vibrations. Generally, commercially available disc-type thermostats only operate within a narrow range of differential temperatures, for example, with temperature differentials of 10° to 30°. Thus, a low temperature operating thermostat which will cycle at low temperatures but not at high temperatures is satisfactory for removing ice or frost from a window but is not satisfactory for removing moisture therefrom if its operating temperature range lays below the dew point of the ambient atmosphere. Likewise, if a high temperature operating thermostat is employed, it will not cycle at low temperatures because of insufficient temperature rise in the sensing area of the window. The narrow operating characteristics of thermostats coupled with the fact that a window must be heated over a broad range of temperatures to both defrost and demist it, poses a special problem. The instant invention overcomes this problem by providing a higher heat area in a selected region 37 in the first heatable zone 21 that produces a temperature which is sensed by the thermostat 30, a high temperature operating thermostat.

Figure 2:
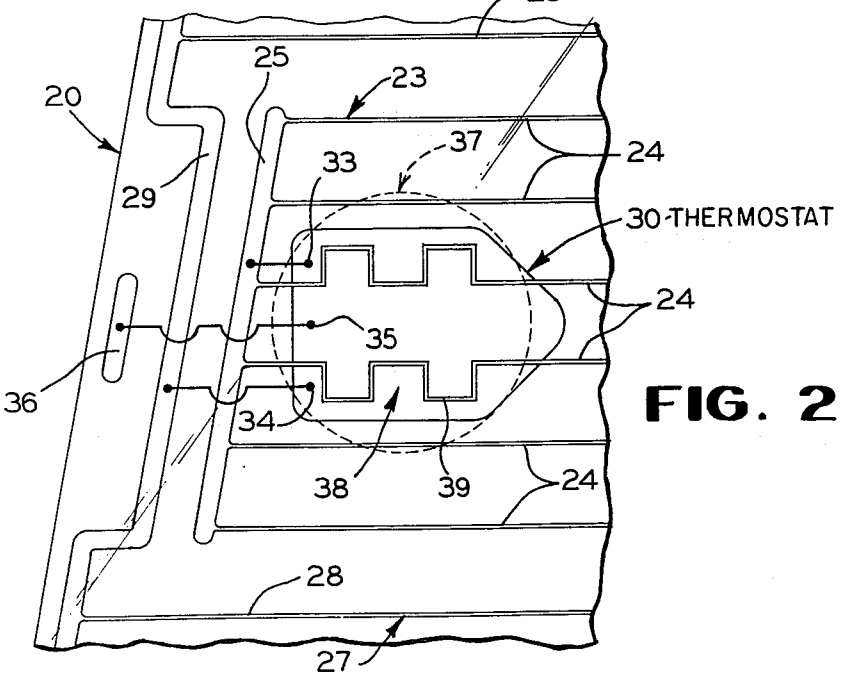
FIG. 2 is an enlarged fragmentary view of the window illustrated in FIG. 1.

Referring particularly to FIGS. 1 and 2, the region 37 is formed by a secondary heating component 38 which as shown therein constitutes a portion of the heating element 23. More particularly, the component 38 comprises a pair of square toothed extensions 39 formed in two of the electroconductive lines 24 to provide a more concentrated pattern of resistance heating elements and thus the higher heat region 37. The component 38 insures that the glass in the area 37 is raised to a temperature high enough to fall within the operating temperature range of the thermostat.

Figure 4:
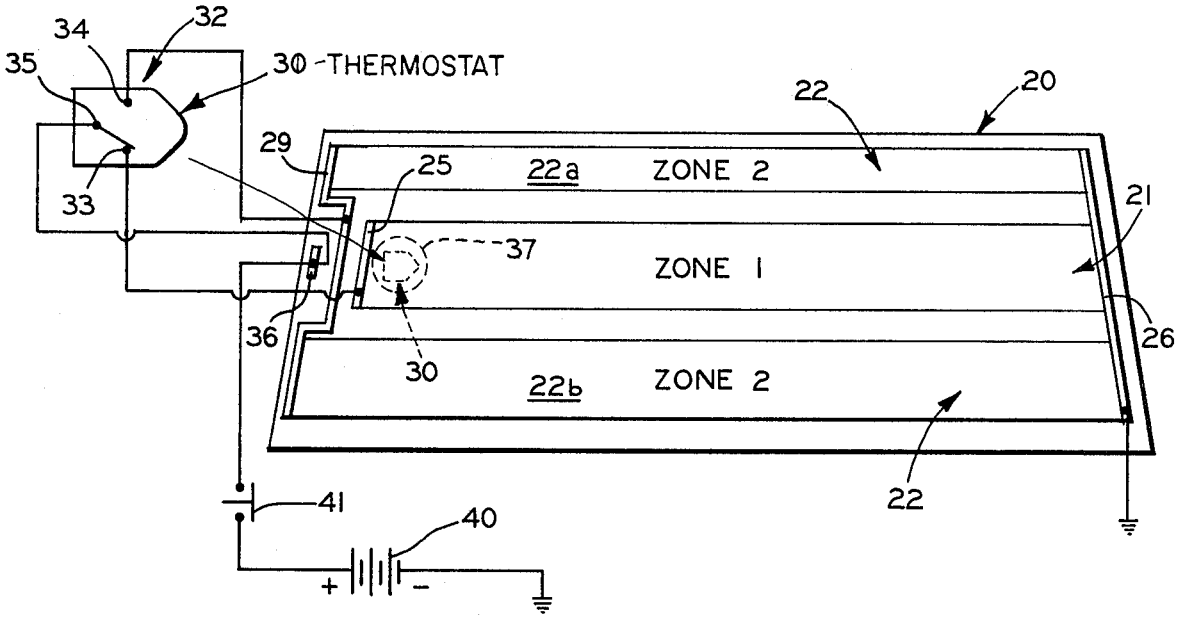
FIG. 4 is a schematic diagram showing the electrical connections for the direct control of the application of electrical potential by the thermostat.

Referring to FIG. 4, it will be noted that the thermostat 30 which for clarity is shown removed from the backlight, completes the circuit from a battery 42 to either the first or second heating element 23 and 27, respectively. Thus, in operation and assuming that the glass backlight is at a temperature below the lower temperature limit of the thermostat, the battery voltage is connected directly to the heating element 23 through the thermostat 30 when the manual on-off switch 41 is closed. Subsequently, when the temperature of the region 37 reaches the upper temperature limit of the thermostat 30, the switch 32 opens the circuit to the heating element 23 and closes the circuit to the heating element 27. When the temperature in the region 37 again falls below the lower temperature limit of the thermostat 30, the switch 32 will open the circuit to the heating element 27 to again impress the battery voltage on the heating element 23. In this manner, the critical viewing area defined by the zone 21 is kept free of any accumulation of frost and moisture after such has once been removed from this area.

In some instances, it may be desirable to attach a smaller, less conspicuous thermostat on the backlight 20. Although these smaller size thermostats can carry the full electrical potential (voltage) of the battery they do not have the capability of carrying the full high load electrical current of the battery 40. In this situation, referring to FIG. 5, a relay 42 is employed to carry the electrical current produced by the battery 40 to the heating elements 23 and 27 and a small size thermostat 30′ controls the open and closed contacts of the relay 42.

Figure 5:
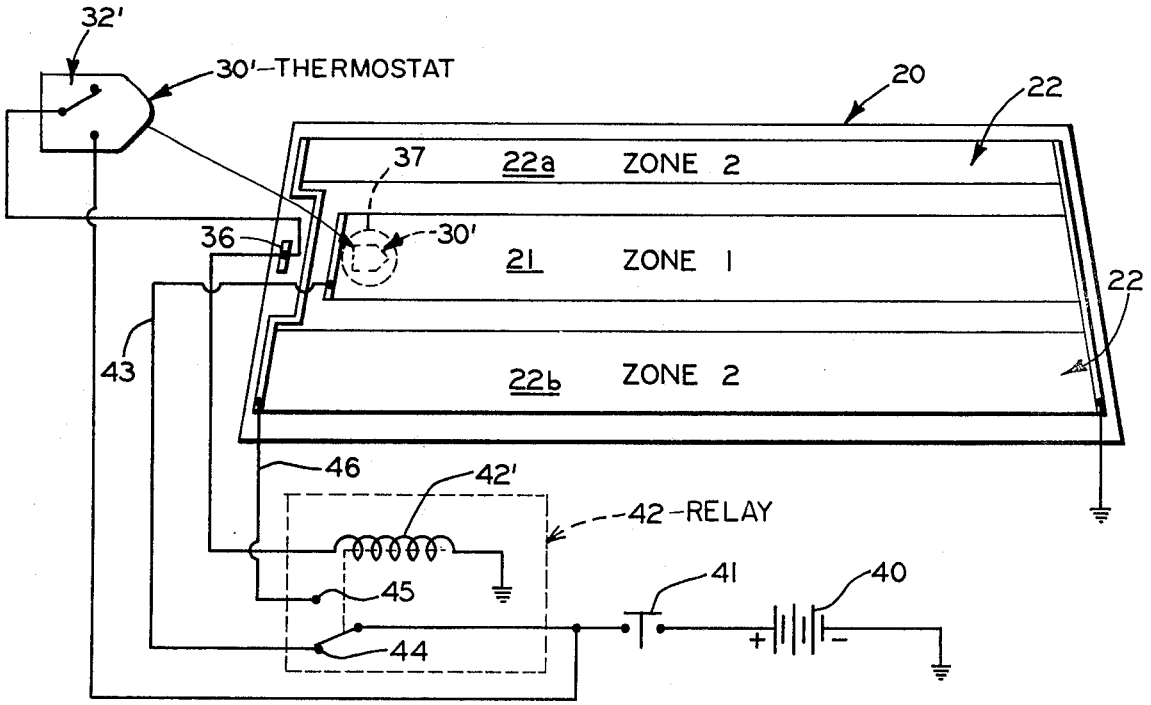
FIG. 5 is a schematic diagram showing the electrical connections for the indirect control of the application of electrical potential by a thermostat.

As illustrated in FIG. 5, when the thermostat 30′ is in its normally open position, the coil 42′ of the relay 42 is in its de-energized condition. Activating the on-off switch 41 causes electrical potential from the battery 40 to be supplied directly to the heating element 23 by a conductor 43 connected between the normally closed contact 44 of the relay 42 and the bus bar 25 of the heating element 23. When the glass temperature in the selected region 37 in the heatable zone 21 reaches the upper limit of the thermostat, the thermal switch 32′ of the thermostat 30′ will close, thereby energizing the coil 42′ of the relay 42 to open the contact 44 and close the contact 45 of the relay 42 and supply electrical current to the bus bar 29 of the heating element 27 by a conductor 46. The thermostat 30′ will cycle the supply of electrical current between the heating elements 23 and 27 via the relay 42 as previously described for the embodiment of the invention shown in FIG. 4.

As previously indicated, the invention may be incorporated in two windows as well as a single window as described above. Thus, the embodiment of the invention shown in FIG. 6 includes an electrically heated windshield 47 constituting a first heatable zone 21′ and an electrically heatable backlight 20′ constituting a second heatable zone 22′.

Figure 6:
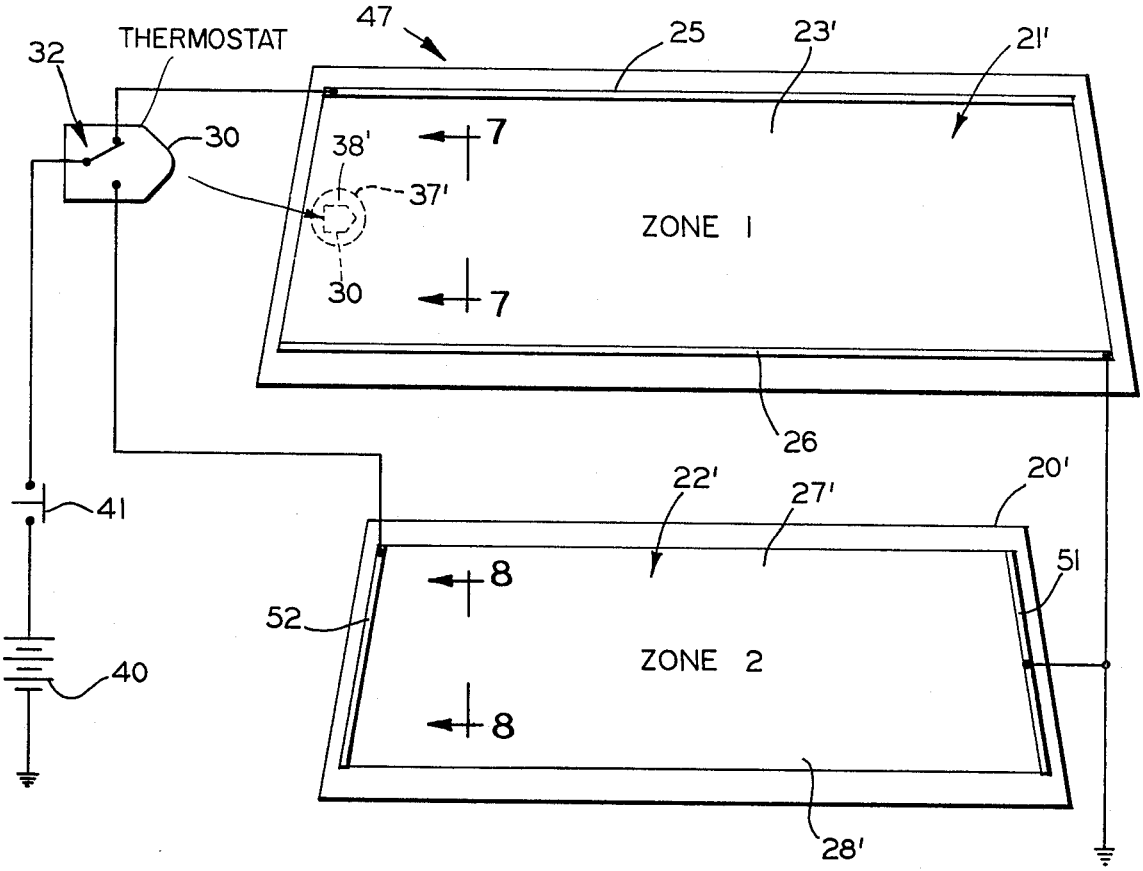
FIG. 6 is a schematic diagram of another embodiment of the invention showing the apparatus incorporated into two separate windows.
Figure 7:
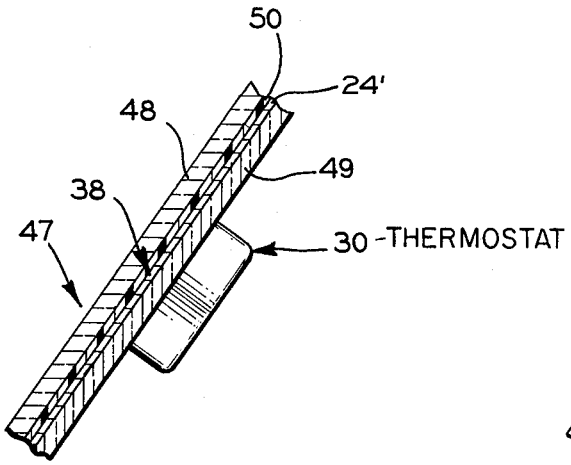
FIG. 7 is an enlarged fragmentary cross sectional view taken substantially along line 7—7 in FIG. 6.

As shown in FIG. 6, a heating element 23′ for heating the zone 21′ of the windshield comprises a transparent electrically conductive sheet 24′ which is in electrical contact with a pair of bus bars 25′ and 26′ spaced apart from one another to permit an electric current to flow from one to the other via the conductive sheet 24′. Preferably, as shown in FIG. 7, the windshield 47 is a laminated structure including an outer glass sheet 48, an inner glass sheet 49, and a plastic interlayer 50 such as polyvinyl butyral positioned therebetween. The electrically conductive sheet 24′ may be a film or coating deposited on the plastic interlayer 50 or the glass sheet 49.

Figure 8:
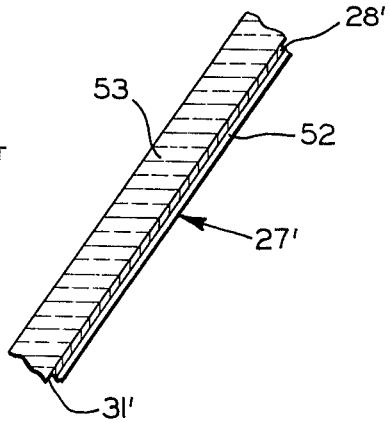
FIG. 8 is an enlarged fragmentary cross sectional view taken substantially along line 8—8 in FIG. 6.

Referring now to FIG. 6, a heating element 27′ for heating the zone 22′ in the backlight 20′ comprises a transparent electrically conducting sheet 28′ which is in electrical contact with a pair of bus bars 51 and 52, spaced apart from one another to permit electric current to flow from one to the other via the conductive sheet 28′. As shown in FIG. 8, the backlight 20′ is made from a tempered glass sheet 53, on the inboard surface 31′ of which is deposited a transparent electroconductive film, for example, composed of tin oxide, which constitutes the sheet 28′.

A thermostat such as the thermostat 30 is attached to the windshield 47 in a selected region 37′ of the first heatable zone 21′ which is heatable to a higher temperature than the rest of the zone 21′ by a secondary heating component 38′ which may constitute a portion of the electroconductive film 24′.

As is well known, heat provided by electric current is a function of the square of the current times the resistance ($I^2R$), thus an increase in the thickness of the conductive film in the area of the glass of the selected region 37′ will give a reduction in resistance in this area and a consequent increase in current flow thereby increasing the heat in this area. Also, the desired amount of heat in the selected region 37′ can be provided by other means, for example, the resistance of a portion of and consequently its conductivity can be altered by varying the concentration of the filming solution in this area, or by the addition of materials such as antimony to the filming solution which will decrease its resistance. The heating component 38′ can be formed in the conductive film 24′ by masking patterns during the filming process or by use of selective chemical or mechanical film alterations after filming to create a localized higher heat area in the selected region 37′.

The operation of this embodiment of the invention is similar to the operation previously described for the embodiment shown in FIG. 4. That is, electrical potential is first supplied directly by the thermostat 30 to the heating element 23′ by activating the on-off switch 41. When the temperature in the selected region 37′ rises to the upper temperature level of the thermostat 30, the thermal switch 32 thereof switches the electrical potential to the heating element 27′ on the backlight 20′. Then when the temperature of the selected region 37′ falls below the lower temperature level of the thermostat 30, the electrical potential will be switched again to the heating element 23′ on the windshield 47. In this manner, the windshield 47 is first cleared of frost and moisture and is kept free of any further accumulation of frost and moisture.

It is to be understood that the form of the invention herewith shown and described is to be taken as an illustrative embodiment only of the same, and that various changes in the shape, size, and arrangement of the parts may be resorted to without departing from the spirit of the invention.

I claim:

1. In an electrically heated window system of the type having at least two heatable zones, wherein each zone is provided with its own independent electrical resistance heating element and a supply of electrical potential connectable to said heating elements of said zones for energization thereof, the improvement comprising:

a. means for producing a higher temperature in a selected region in one of said heatable zones than the average overall temperature produced by said heating element in said one zone;

b. means located at said selected region for sensing its said higher temperature; and c. means operated by said temperature sensing means for initially connecting the heating element of said one heatable zone to said supply of electrical potential and then alternately cycling the electrical potential between the respective heating elements of said zones in accordance with the rise and fall of the temperature in said selected region.

2. An electrically heated window system as claimed in claim 1, wherein said higher temperature producing means comprises a portion of said heating element in said one zone.

3. An electrically heated window system as claimed in claim 2, wherein said portion of said heating element encompasses an area smaller in size than the remaining area of said one zone and the electrical resistance of said heating element in said smaller area is lower than the resistance of said heating element in the remaining area of said one zone.

4. An electrically heated window system as claimed in claim 1, wherein each said heating elements comprises a plurality of electroconductive frit lines.

5. An electrically heated window system as claimed in claim 4, wherein said higher temperature producing means comprises at least one electroconductive line of the heating element of said one zone configurated to form a concentrated heat pattern in said selected region.

6. In a heated transparent window system of the type having first and second electrically heated zones wherein each zone is provided with an independent electric heating means, and a source of electrical energy adapted for connection to said zones, the improvement comprising:

a. a heating component in circuit with the heating means for said first zone disposed in a selected region of said first zone for producing a higher temperature in said region than the temperature produced in the remainder of said zone by the heating means for said zone; and b. a thermostatic switch in thermal contact with said selected region, said switch being arranged to cycle electrical energy from said source between the electric heating means of said first zone and the electric heating means of said second zone depending upon the temperature in said region sensed by said switch.

7. A heated transparent window system as claimed in claim 6, wherein said thermostatic switch directly connects said source of electrical energy to said heating means.

8. A heated transparent window system as claimed in claim 6, wherein said thermostatic switch indirectly connects said source of electrical energy to said heating means.

9. A heated transparent window system as claimed in claim 8, including a relay controlled by said thermostatic switch.

10. A heated transparent window system as claimed in claim 6, wherein said first and second heated zones, each include an electrical resistance element comprising a plurality of parallel spaced apart electroconductive lines.

11. A heated transparent window system as claimed in claim 10, wherein said heating component comprises a portion of the electroconductive lines in said first zone.

12. A heated transparent window system as claimed in claim 6, wherein said heated zones each include a resistance element comprising a sheet of electroconductive material.

13. A heated transparent window system as claimed in claim 12, wherein said electroconductive sheet in said first zone includes a portion having an electrical power density higher than the power density in the remainder of said sheet for producing a higher heat area in said sheet.

* * * * *